US006475042B1

(12) United States Patent
Yu

(10) Patent No.: US 6,475,042 B1
(45) Date of Patent: Nov. 5, 2002

(54) HIGH-SPEED ELECTRICAL CONNECTOR

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/014,616

(22) Filed: Dec. 10, 2001

(51) Int. Cl.[7] ..... H01R 13/11
(52) U.S. Cl. ..... 439/857; 439/943
(58) Field of Search ..... 439/943, 752.5, 439/682, 857, 856

(56) References Cited

U.S. PATENT DOCUMENTS 4,188,715 A * 2/1980 Ammon et al. ..... 439/943
4,918,813 A * 4/1990 Mori et al. ..... 439/857
5,860,838 A * 1/1999 Kaneko ..... 439/857
6,109,974 A * 8/2000 Kodaira ..... 439/857
6,171,126 B1 * 1/2001 Wu et al. ..... 439/857
6,217,395 B1 * 4/2001 Flieger et al. ..... 439/857

* cited by examiner

*Primary Examiner*—Gary F. Paumen
(74) *Attorney, Agent, or Firm*—WeiTe Chung

(57) ABSTRACT

An electrical connector (100) for mounting on a PCB (3) to electrically connect different electrical components includes an insulative housing (1) with a plurality of passageways (13) defined therethrough for receiving a corresponding plurality of electrical contacts (2) therein. Each passageway (13) has a downwardly facing sidestep (136) forming a stopping surface (137) in one inner wall of the passageway (13) towards a bottom surface (12) of the housing (1). Each electrical contact (2) has a retaining portion (24) confronting the stopping surface (137) of the passageway (13). The contacts (2) is retained in position by the stopping surface (137) when the connector (100) is mounted to the PCB (3).

1 Claim, 6 Drawing Sheets

HIGH-SPEED ELECTRICAL CONNECTOR

BACKGROUND OF THE INVENTION

1. Field of the Invention

The present invention relates to the art of electrical connectors, and more particularly to a high-speed electrical connector having retention mechanism which can prevent contacts retained in the connector from deformation during inserting in a direction perpendicular to a printed circuit board (PCB) when the connector is mounted to the PCB.

2. Description of the Related Art

A conventional high-speed electrical connector 500 commonly has a plurality of electrical contacts 52 as shown in FIGS. 6 and 7, each of which has a press-fit retaining portion 524. When the connector 500 is mounted to a printed circuit board (PCB) 53, the retaining portions 524 of the contacts 52 are inserted into through holes 531 in the PCB 53. Each through hole 531 has a diameter less than a dimension of the retaining portion 524. The connector 500 can be mounted on the PCB 53 by pressing the retaining portions 524 of the contacts 52 into the through holes 531 without additional soldering process.

When the connector 500 is mounted to the PCB 53, the retaining portions 524 of the contacts 52 confront sidewalls of the PCB 53 around the through holes. The contacts 52 are retained in passageways 513 of the housing 51 by barbs 523 protruding from opposite sides of each contact 52. However, the barbs 523 are insufficient to securely retain the contacts 52 in the passageways 513 if the insertion force during the mating process is too high. The contacts 52 will slide upwardly along the passageways 513 as the housing 51 is pressed downwardly, which leads to the contacting portion 521 of the contacts 52 resisting an inner face 518 of a top wall of the housing 51. Under such condition, the contacting portions 521 will bias from their proper position, thereby failing to electrically connect with corresponding contacts of a mating connector (not shown). In addition, the insertion force acted on a tail portion 525 of the contact 52 may subject the tail portion 525 to a force in a direction perpendicular to the insertion direction which alters the pitch of the contacts thereby adversely affecting insertion of the contacts 52 into the holes 531 defined in the PCB 53.

Therefore, an improved connector and compliant contacts are required having an improved retention mechanism for retaining the contacts within a housing of a connector which will eliminate undue deformation of the contacts. Copending application Ser. No. 10/013,417 filed on Dec. 7, 2001 having the same inventor, the same title and the same assignee with the invention, discloses one approach of this issue.

SUMMARY OF THE INVENTION

An object of the present invention is to provide an improved connector with contacts having retaining mechanisms for positioning the contacts in true positions when the connector is mounted to a PCB.

In order to achieve the object set forth, an electrical connector in accordance with the present invention includes an insulative housing defining a plurality of passageways therethrough and a plurality of contacts received in the passageways. Each passageway has a downwardly facing sidestep in an inner wall thereof forming a stopping surface. Each contact has a base portion and a pair of contacting portions received in the passageway of the housing and a press-fit tail portion extending downwardly from the bottom surface of the housing. A retaining portion extends upwardly from the base portion and resists against the stopping surface of the sidestep of the passageway. Thus, when the contacts of the connector are inserted into through holes in a PCB, the contacts are prevented by the sidesteps from sliding upwardly along the passageways.

DESCRIPTION OF THE PREFERRED EMBODIMENT

Reference will now be made in detail to the preferred embodiment of the present invention.

Figure 1:
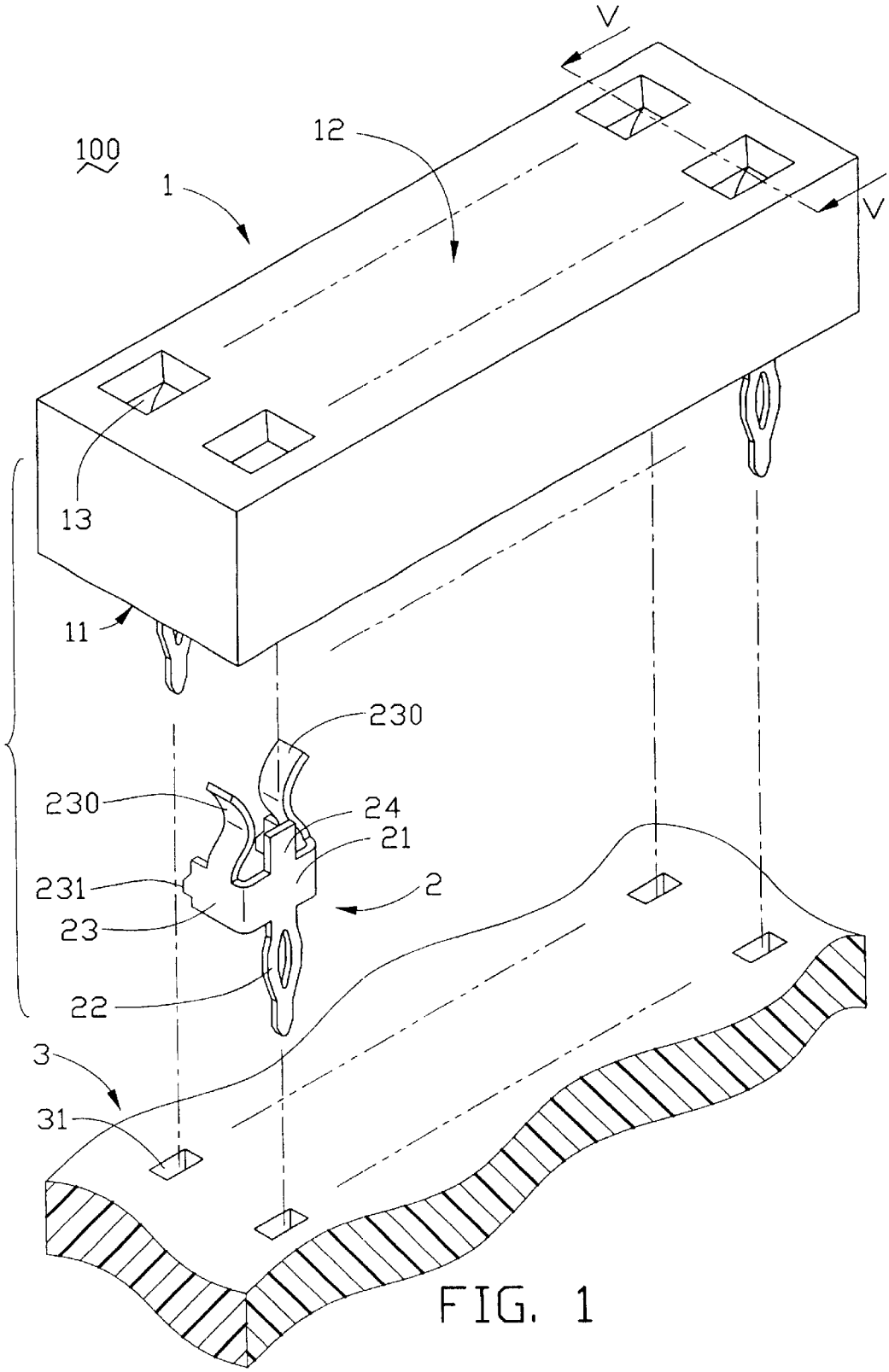
FIG. 1 is an exploded view of an electrical connector in accordance with the present invention together with a PCB.

Referring to FIG. 1, an electrical connector 100 in accordance with a preferred embodiment of the present invention includes an insulative housing 1 and a plurality of electrical contacts 2 received in the housing 1.

Figure 2:
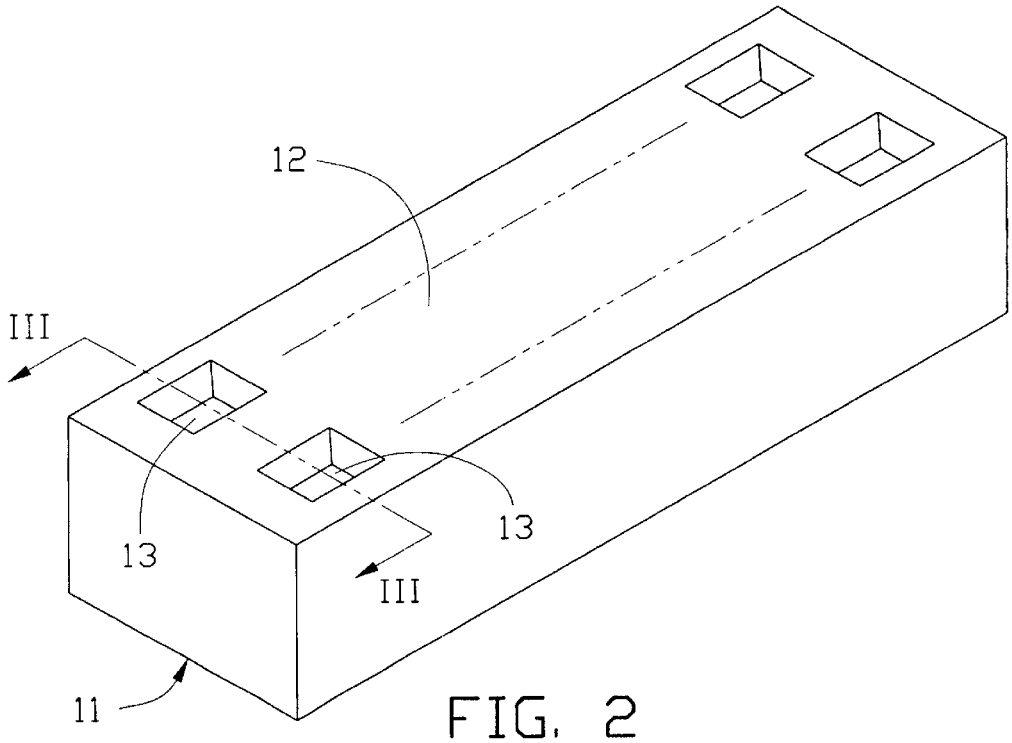
FIG. 2 is a perspective view of an insulative housing of the electrical connector of FIG. 1.
Figure 3:
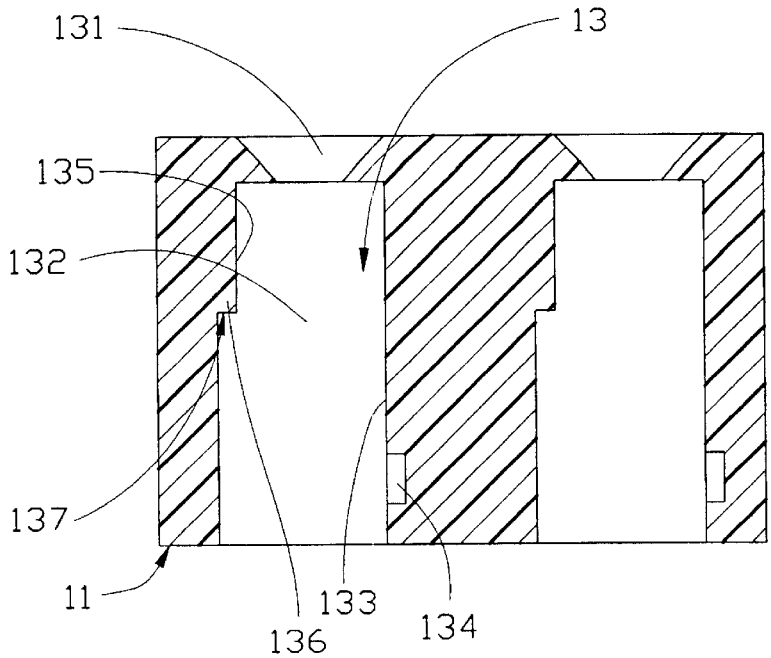
FIG. 3 is a cross-sectional view, taken along line III—III of FIG. 2.

Referring particularly to FIGS. 2 and 3, the housing 1 of the connector 100 has a mounting bottom surface 11 for mounting onto the PCB 3, a mating top surface 12 for mating with a mating connector (not shown), and a plurality of passageways 13 defined therein extending through the top and bottom faces 12, 11 for receiving a plurality of contacts 2 therein. Each passageway 13 has a diverged opening 131 in the top surface 12 of the housing 1 and a receiving room 132 adjacent to the opening 131 and extending downwardly through the bottom surface 11. A first inner wall 133 of the receiving room 132 has a pair of recesses 134 concaved therein, and a second inner wall 135 opposing the inner wall 133 forms a downwardly facing sidestep 136 which has a stopping surface 137 towards the bottom surface 12 of the housing 1. Thus, the passageway 13 presents a ladderlike cross-section that has a narrower upper section and a wider lower section.

Figure 4:
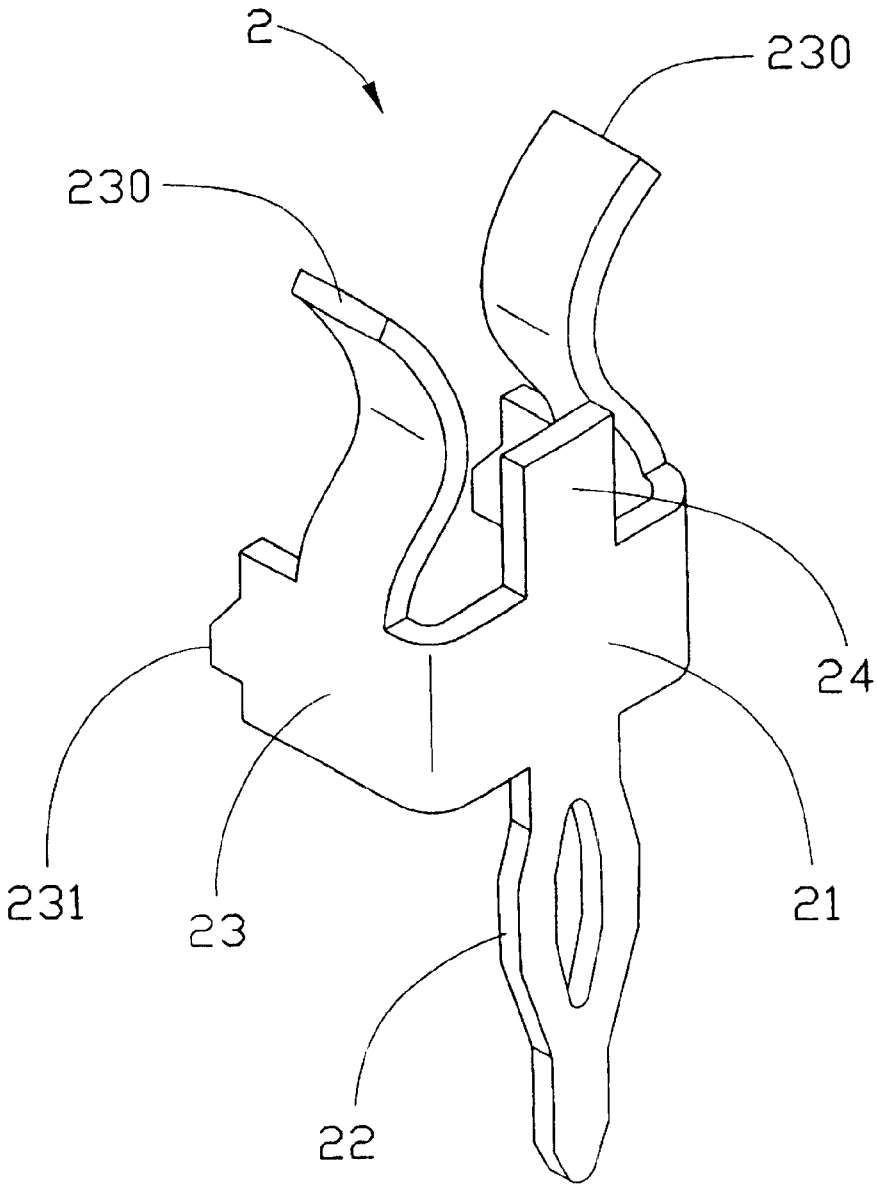
FIG. 4 is a perspective view of a contact of the electrical connector of FIG. 1.

As shown in FIG. 4, each contact 2, formed commonly by stamping operation, includes a base portion 21, a press-fit tail portion 22 extending downwardly from a lower edge of the base portion 21, a pair of arm portions 23 extending perpendicularly from opposite ends of the base portion 21, and a retaining portion 24 extending upwardly from an upper edge of the base portion 21. The pair of arm portions 23 each has a spring contacting portion 230 extending upwardly for engaging with a corresponding plug contact (not shown), and a barb portion 231 protruding from a free end thereof for securing into the corresponding recess 134 of the housing 1. The contacting portions 230 are perpendicular to the retaining portion 24. The barb portion 231 and the retaining portion 24 are located at opposite sides of the contacting portion 230.

Figure 5:
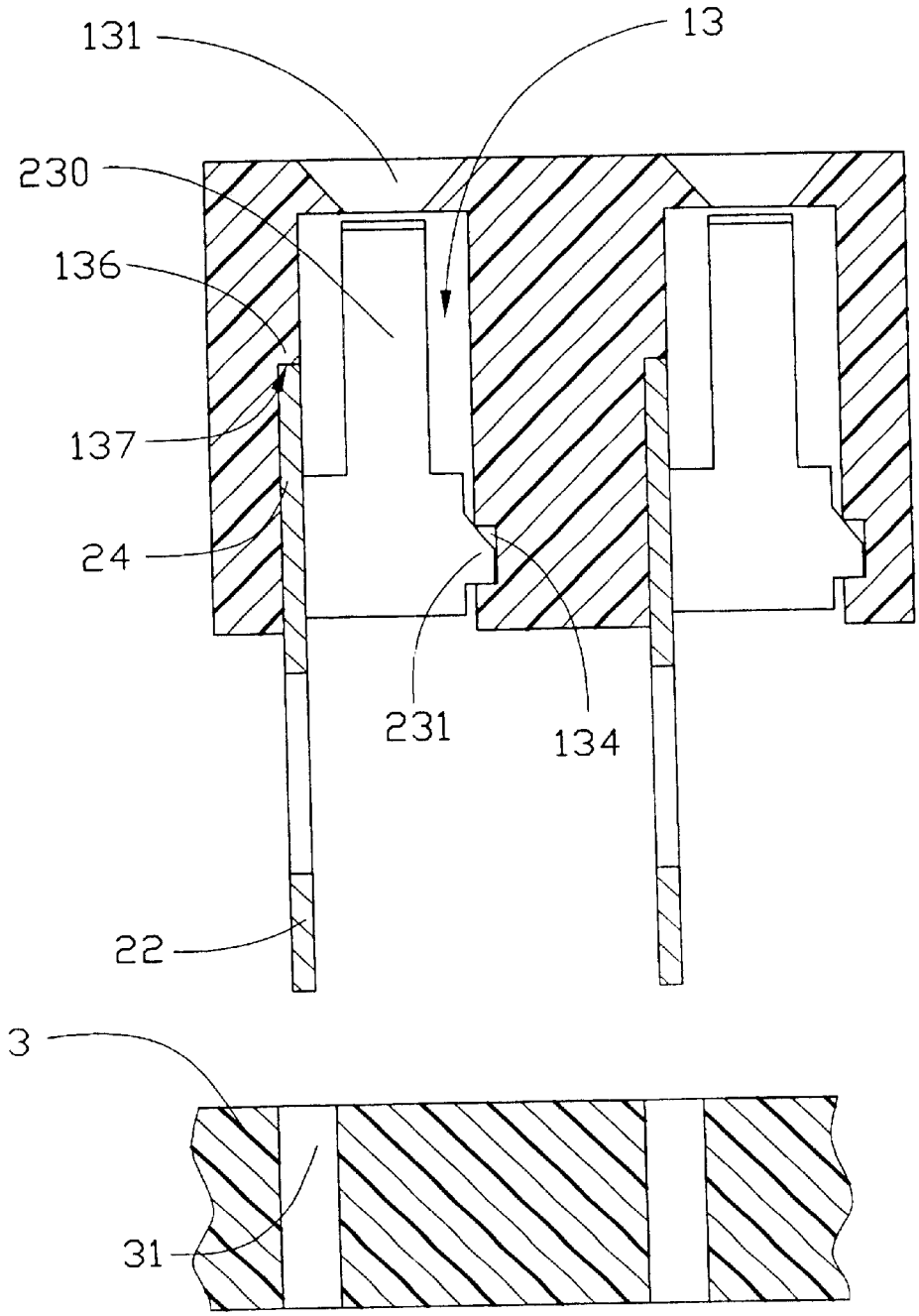
FIG. 5 is a cross-sectional view of the electrical connector, taken along line V—V of FIG. 1.
Figure 6:
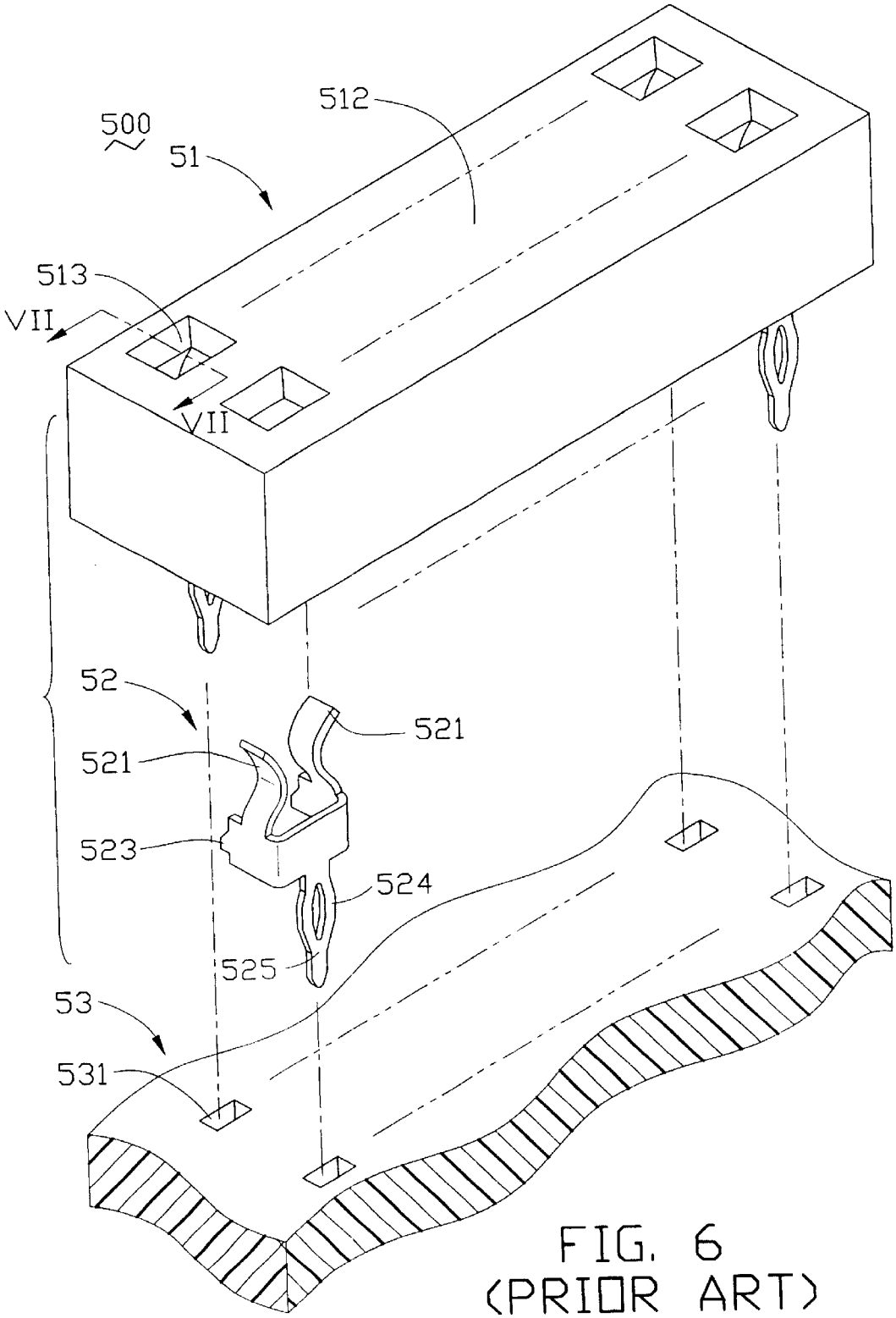
FIG. 6 (PRIOR ART)
FIG. 6 is an exploded view of a conventional electrical connector together with a PCB.
Figure 7:
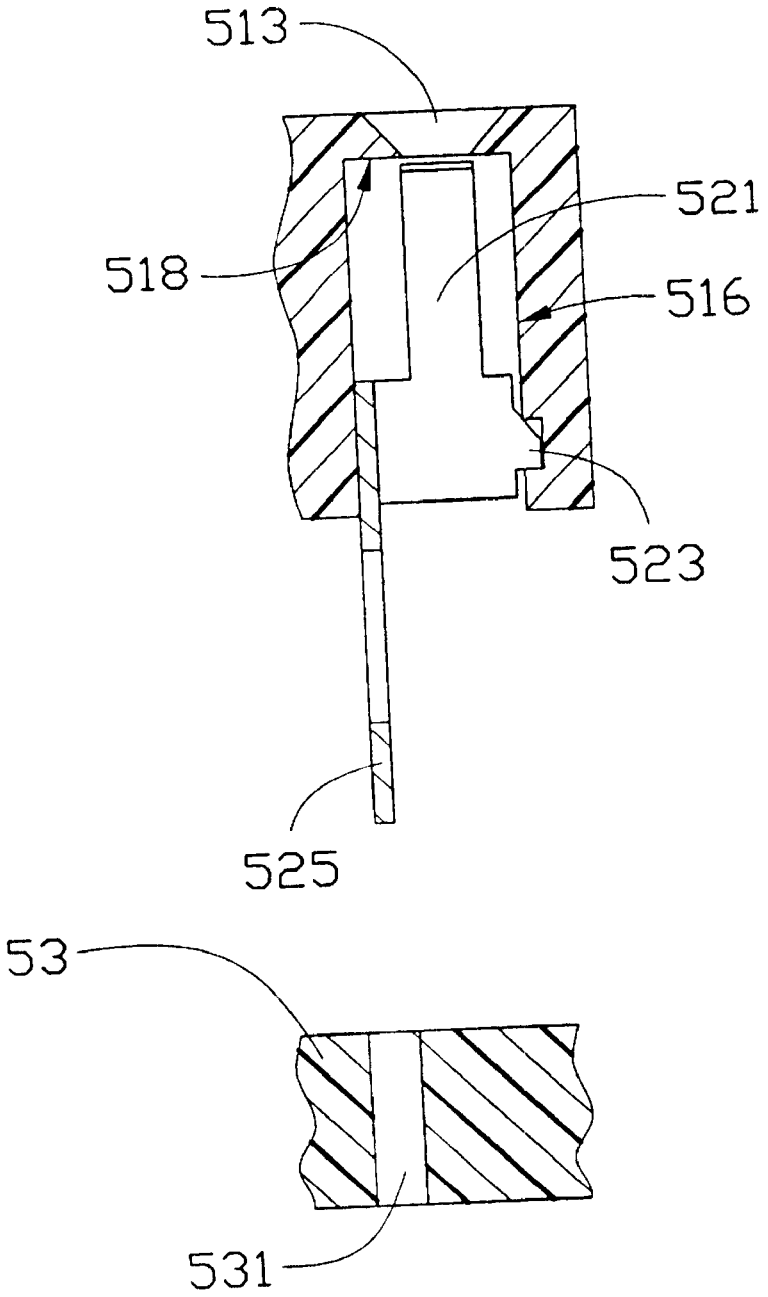
FIG. 7 (PRIOR ART)
FIG. 7 is a cross-sectional view of the connector and the PCB taken along line VII—VII of FIG. 6.

Referring to FIG. 5, the contacting portions 230 and the base portion 21 of each contact 2 are accommodated in the receiving room 13, the tail portion 22 extends out from the passageway 13, and the two barb portions 231 are respectively received in the recesses 134. The retaining portion 24 of each contact 2 abuts against the stopping surface 137 of the sidestep 136.

The connector 100 is mounted to the PCB 3 with the tail portion 22 of the contacts 2 being inserted into the through holes 31 of the PCB 3. Since the through holes 31 are smaller than the tail portions 22, the contacts 2 are subject to an upward force tending to force the contacts 2 to slide upwardly. Nevertheless, the contacts 2 are retained in position in a way that the retaining portions 24 are stopped by the stopping surface 137 of the sidestep 136 and the barb portions 231 locked in the recess 133. Moreover, the tail portion 22 and the retention portion 24 are vertically aligned so that the force is completely counteracted by the stopping surface 137, thereby the contacts 2 being kept from rotation and upward movement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting on a PCB, comprising:

an insulative housing having a top surface, a bottom surface and a plurality of passageways extending from the bottom surface to the top surface, each passageway having a downwardly facing sidestep which forms a stopping surface towards the bottom surface;

a plurality of contacts fixed in the housing, each contact having a base portion, a pair of arm portions defined at opposite ends of the base portion, a tail portion extending downwardly from the base portion, and a retaining portion extending upwardly from the base portion; and wherein the retaining portions of the contacts confront the stopping surfaces whereby the retaining portions press against the sidesteps when the connector is mounted to the PCB;

wherein each retaining portion of the contact is vertically aligned with corresponding tail portion;

wherein the passageway has a ladder like cross-section and has a pair of recesses opposite the sidestep;

wherein each arm portion has a spring contacting portion extending upwardly from an upper edge thereof and a barb portion protruding laterally from a free end thereof, the barb portion being received in a corresponding recess of the passageway;

wherein the retaining portion, the base portion and the tail portion of the contact are coplanar.

* * * * *